US011655678B2

(12) United States Patent
Munguia et al.

(10) Patent No.: US 11,655,678 B2
(45) Date of Patent: May 23, 2023

(54) MUD MOTOR BEARING ASSEMBLY FOR USE WITH A DRILLING SYSTEM

(71) Applicant: Halliburton Energy Services, Inc., Houston, TX (US)

(72) Inventors: Joseph Robert Munguia, Houston, TX (US); Hasib Uddin, Houston, TX (US); John Hardin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 27 days.

(21) Appl. No.: 17/305,567

(22) Filed: Jul. 9, 2021

(65) Prior Publication Data

US 2023/0011364 A1 Jan. 12, 2023

(51) Int. Cl.

| | |
|---|---|
| ***E21B 4/00*** | (2006.01) |
| ***E21B 7/06*** | (2006.01) |
| ***E21B 4/02*** | (2006.01) |

(52) U.S. Cl.

CPC ..... *E21B 4/003* (2013.01); *E21B 4/02* (2013.01); *E21B 7/068* (2013.01)

(58) Field of Classification Search

CPC ..... E21B 4/003; E21B 4/02; E21B 7/068

See application file for complete search history.

(56) References Cited

U.S. PATENT DOCUMENTS

| | | | |
|---|---|---|---|
| 2004/0104051 | A1 | 6/2004 | Moriarty et al. |
| 2019/0085656 | A1 | 3/2019 | Jerez |

FOREIGN PATENT DOCUMENTS

| | | | |
|---|---|---|---|
| EP | 3004527 | B1 | 11/2017 |
| WO | 2014021899 | A1 | 2/2014 |
| WO | 2021087347 | A1 | 5/2021 |

OTHER PUBLICATIONS

International Search Report and Written Opinion dated Apr. 1, 2022 for corresponding PCT Application No. PCTUS2021070899 filed Jul. 19, 2021.

*Primary Examiner* — Kristyn A Hall
(74) *Attorney, Agent, or Firm* — K&L Gates LLP

(57) ABSTRACT

A drilling system for drilling a borehole. The drilling system may include a drill string, a drill bit coupled to the drill string, a mud motor coupled to the drill string uphole of the drill bit and operable to rotate the drill bit via a driveshaft, a bearing assembly coupled to a downhole end of the mud motor and operable to support the driveshaft, and a rotary steerable system ("RSS") operable to push the drill bit in a desired direction via pads extended using drilling fluid flowing through the driveshaft and to the RSS. The bearing assembly may include bearings positioned circumferentially around a bore of the bearing assembly, a fluid flowpath through the bearings to allow drilling fluid to pass through the bearings, and a choke assembly positioned in the fluid flowpath and operable to restrict a flow of the drilling fluid through the fluid flowpath.

20 Claims, 4 Drawing Sheets

MUD MOTOR BEARING ASSEMBLY FOR USE WITH A DRILLING SYSTEM

BACKGROUND

Directional drilling involves drilling a borehole that deviates from a vertical path, such as drilling horizontally through a subterranean formation. Rotary steerable systems are employed to control the direction of a drill bit while drilling. In a point-the-bit rotary steerable system, an internal shaft within the system is deflected to direct the drill bit. In a push-the-bit rotary steerable system, a pad pushes against the subterranean formation to direct the bit.

A push-the-bit rotary steerable system includes a motor with a bearing section. The bearing section may be sealed and lubricated by internal oil, or unsealed and lubricated by drilling fluid flowing through the mud motor to the drill bit. For an unsealed bearing section, loss of drilling fluid to the annulus is inevitable due to bearing tolerances, manufacturing constraints, and erosive wear from the flowing mud. The fluid flow to annulus can be used to lubricate the bearing section, but the flow must be controlled to provide pad force to steer the drill bit while avoiding excess erosion. A need exists, therefore, for a means of controlling the bypass flow of drilling fluid to the annulus

BRIEF DESCRIPTION OF THE DRAWINGS

Embodiments of the systems for plugging a well are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides a mud motor bearing assembly for use with a drilling system. The bearing assembly includes radial bearings, thrust bearings, and/or ball bearings or roller bearings that support a driveshaft that extends between the mud motor and a drillbit. The bearing assembly also includes a fluid flowpath through the bearings and into an annulus surrounding the bearing assembly that allows drilling fluid to pass through the bearings, lubricating and cooling the bearings. The bearing assembly also includes a choke assembly that restricts the flow of drilling fluid through the bearings.

Although the bearing assembly may be used with many types of drilling systems having a mud motor, the bearing assembly is particularly applicable to a motor-assisted rotary steerable system ("MARSS"). An MARRS utilizes drilling fluid that has passed through the mud motor and the bearing assembly, to extend pads to push the drill bit in a desired direction. By restricting the flow of drilling fluid through the bearings of the bearing assembly, the choke assembly maintains the drilling fluid passing through the bearing assembly to the pads at a sufficient pressure to extend the pads.

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one borehole having a borehole wall. A borehole can include vertical, inclined, and horizontal portions, and it can be straight, curved, or branched. As used herein, the term "borehole" includes any cased, and any uncased, open-hole portion of the borehole. Further, the term "uphole" refers a direction that is towards the surface of the well, while the term "downhole" refers a direction that is away from the surface of the well.

Figure 1:
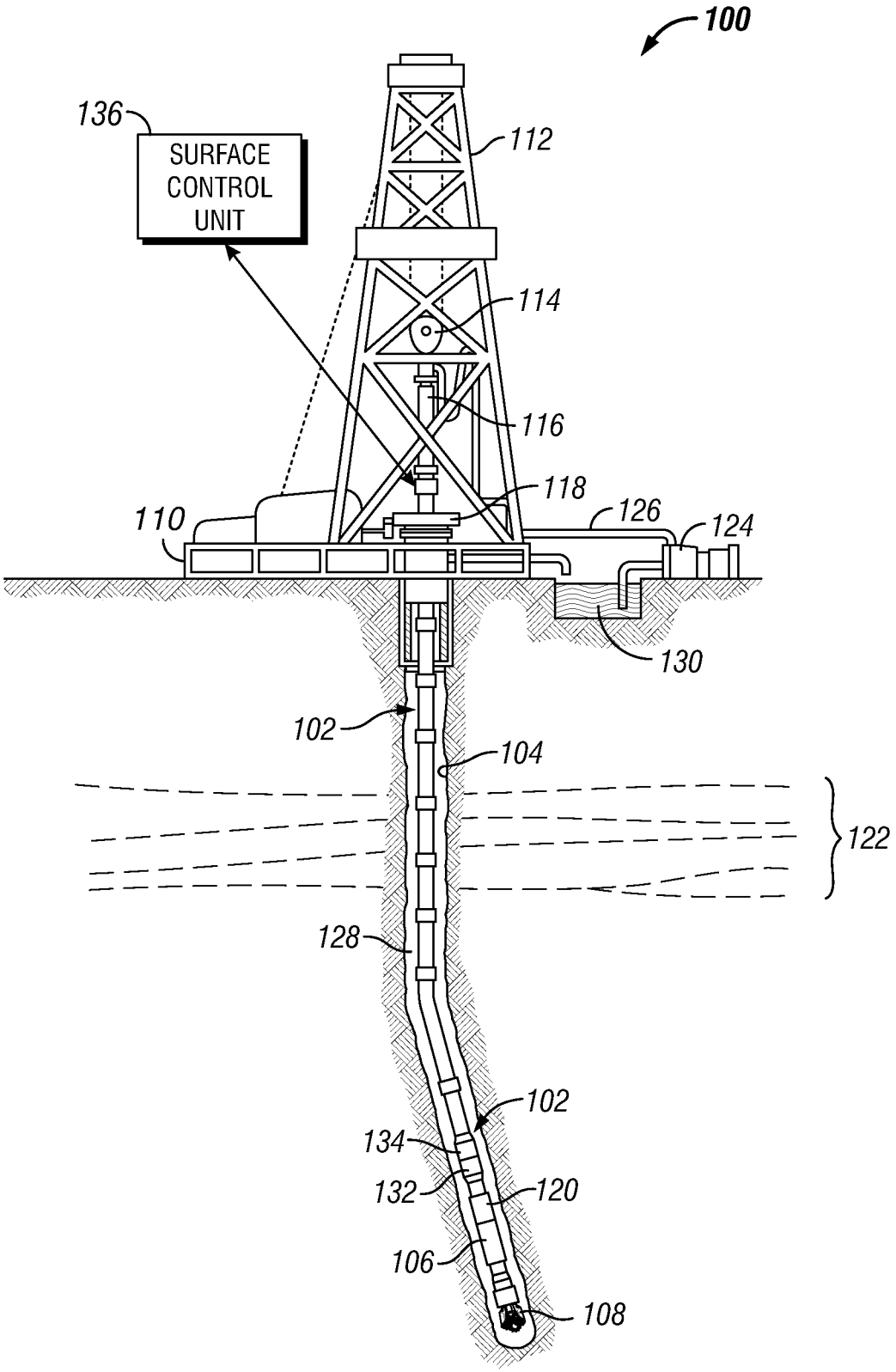
FIG. 1 is a schematic view of a drilling system, according to one or more embodiments.

FIG. 1 is a schematic view of a drilling system 100, according to one or more embodiments. The drilling system 100 of the present disclosure will be specifically described below such that the system is used to direct a drill bit in drilling a wellbore, such as a subsea well or a land well. Further, it will be understood that the present disclosure is not limited to only drilling an oil well. The present disclosure also encompasses natural gas wellbores, other hydrocarbon wellbores, or wellbores in general. Further, the present disclosure may be used for the exploration and formation of geothermal wellbores intended to provide a source of heat energy instead of hydrocarbons.

FIG. 1 shows a drill string 102 disposed in a directional borehole 104. The drill string 102 includes a push-the-bit rotary steerable system ("RSS") 106 that provides full 3D directional control of the drill bit 108. A drilling platform 110 supports a derrick 112 having a traveling block 114 for raising and lowering a drill string 102. A kelly 116 supports the drill string 102 as the drill string 102 is lowered through a rotary table 118. Alternatively, a top drive can be used to rotate the drill string 102 in place of the kelly 116 and the rotary table 118. A drill bit 108 is positioned at the downhole end of the drill string 102 and is driven by rotation of the entire drill string 102 from the surface and/or by a downhole motor 120 positioned on the drill string 102. As the bit 108 rotates, the bit 108 forms the borehole 104 that passes through various formations 122. A pump 124 circulates drilling fluid through a feed pipe 126 and downhole through the interior of drill string 102, through orifices in drill bit 108, back to the surface via the annulus 128 around drill string 102, and into a retention pit 130. The drilling fluid transports cuttings from the borehole 104 into the pit 130 and aids in maintaining the integrity of the borehole 104. The drilling fluid also drives the downhole motor 120, as discussed in more detail below.

The drill string 102 may include one or more logging while drilling (LWD) or measurement-while-drilling (MWD) tools 132 that collect measurements relating to various borehole and formation properties as well as the position of the bit 108 and various other drilling conditions as the bit 108 extends the borehole 104 through the formations 122. The LWD/MWD tool 132 may include a device for measuring formation resistivity, a gamma ray device for measuring formation gamma ray intensity, devices for measuring the inclination and azimuth of the drill string 102, pressure sensors for measuring drilling fluid pressure, temperature sensors for measuring borehole temperature, etc.

The drill string 102 may also include a telemetry module 134. The telemetry module 134 receives data provided by the various sensors of the drill string 102 (e.g., sensors of the LWD/MWD tool 132), and transmits the data to a surface unit 136. Data may also be provided by the surface unit 136, received by the telemetry module 134, and transmitted to the tools (e.g., LWD/MWD tool 132, rotary steering tool 106, etc.) of the drill string 102. Mud pulse telemetry, wired drill pipe, acoustic telemetry, or other telemetry technologies known in the art may be used to provide communication between the surface control unit 136 and the telemetry module 134. The surface unit 136 may also communicate directly with the LWD/MWD tool 132 and/or the rotary steering tool 106. The surface unit 136 may be a computer stationed at the well site, a portable electronic device, a remote computer, or distributed between multiple locations and devices. The unit 136 may also be a control unit that controls functions of the equipment of the drill string 102.

Figure 2:
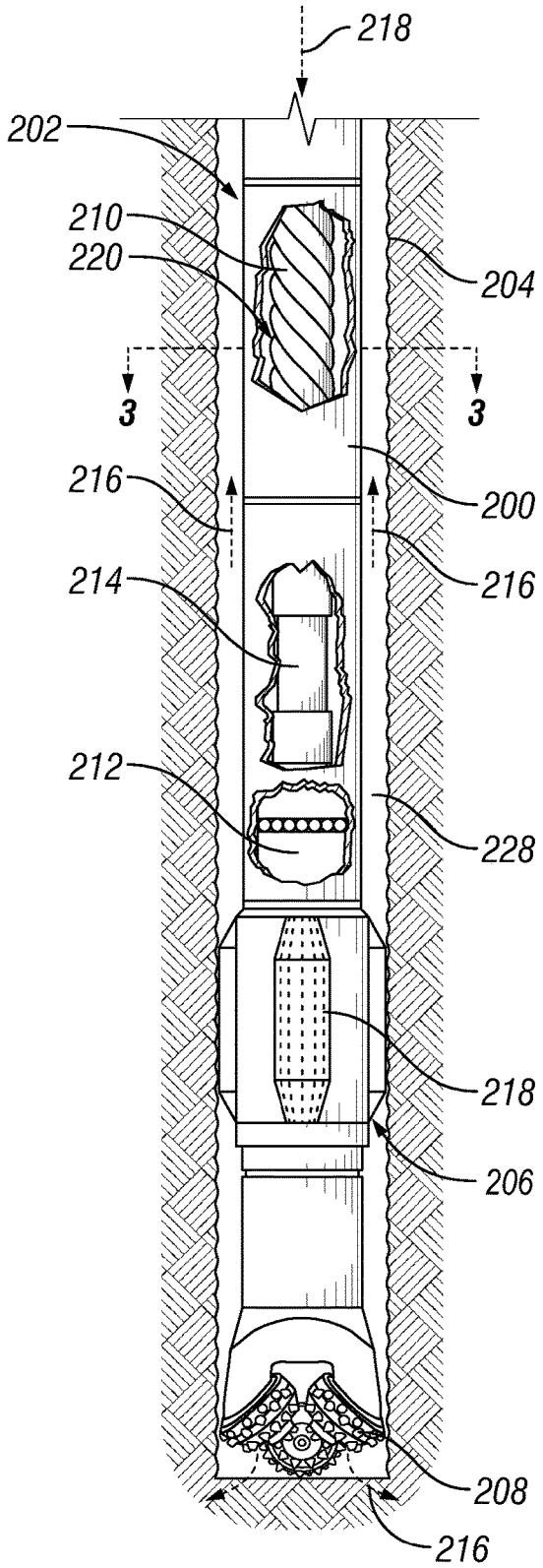
FIG. 2 is a portion of a drill string disposed in a borehole, according to one or more embodiments.
Figure 3:
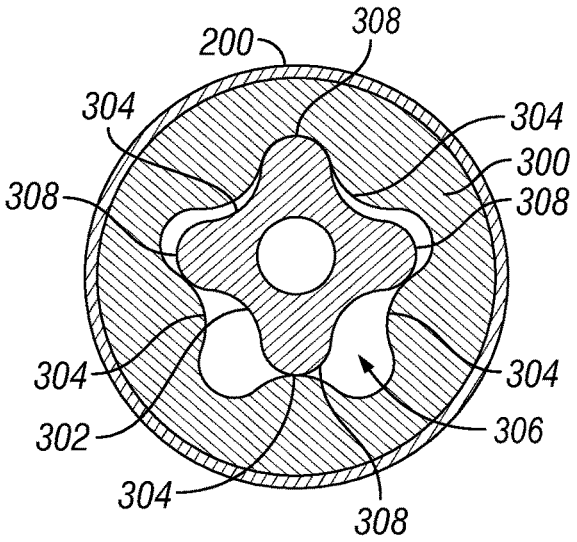
FIG. 3 is a cross-sectional view of the stator and rotor of FIG. 2.

FIGS. 2 and 3 are a broken side view and a cross section view of a drill string 202 disposed in a borehole 204 and that includes a downhole motor 220 connected to a drill bit 208. The downhole motor 220 includes a tubular housing 200 that encloses a power unit 210. The power unit 210 is connected to a bearing assembly 212 via a transmission unit 214. The bearing assembly 212 supports a driveshaft (not shown) extending between the downhole motor 220 and the drill bit 208 to rotate the drill bit 208. Referring to FIG. 3, the power unit 210 includes a stator 300 and a rotor 302. The stator 300 includes multiple (e.g., five) lobes 304 extending along the stator 300 in a helical configuration and defining a cavity 306. The rotor 302 also includes lobes 308 extending along the rotor 302 in a helical configuration. The stator 300 and rotor 302 can also have more or fewer lobes where the difference between the rotor lobes 308 and stator lobes 304 is one extra stator lobe 304 for the number of rotor lobes 308.

The rotor 302 is operatively positioned in the cavity 306 such that the rotor lobes cooperate with the stator lobes 304 in that applying fluid pressure to the cavity 306 by flowing fluid within the cavity 306 causes the rotor 302 to rotate within the stator 300. For example, referring to FIGS. 2 and 3, pressurized drilling fluid (e.g., drilling mud) 216 can be introduced at an upper end of the power unit 210 and forced down through the cavity 306. The pressurized drilling fluid entering cavity 306, in cooperation with the lobes 304 of the stator 300 and the geometry of the stator 300 and the rotor 302 causes the rotor 302 to turn to allow the drilling fluid 216 to pass through the motor 220, thus rotating the rotor 302 relative to the stator 300. The drilling fluid 216 subsequently exits through ports (e.g., jets) in the drill bit 208 and travels upward through an annulus 228 between the drill string 202 and the borehole 204 and is received at the surface where it is captured and pumped down the drill string 202 again.

As shown in FIG. 2, a RSS 206 is positioned on the drill string 202 downhole of the downhole motor 220. Drilling fluid 216 passes through the downhole motor 220 and then through the bearing assembly 212, where a portion of the drilling fluid 216 is diverted and used to cool and lubricate the bearings within the bearing assembly 212, as described in more detail below. The diverted drilling fluid 216 passes through the bearings and into the annulus 228. After the drilling fluid that was not diverted passes through the bearing assembly 212, the drilling fluid 216 provides the hydraulic pressure necessary to extend pads (one indicated, 218) of the RSS 206 to direct the drill bit 208. In order to provide sufficient pressure to extend the pads 218 of the RSS 206, the amount of drilling fluid 216 diverted through the bearings must be controlled to maintain the amount of hydraulic pressure available to extend the pads 218 above an appropriate amount.

Figure 4:
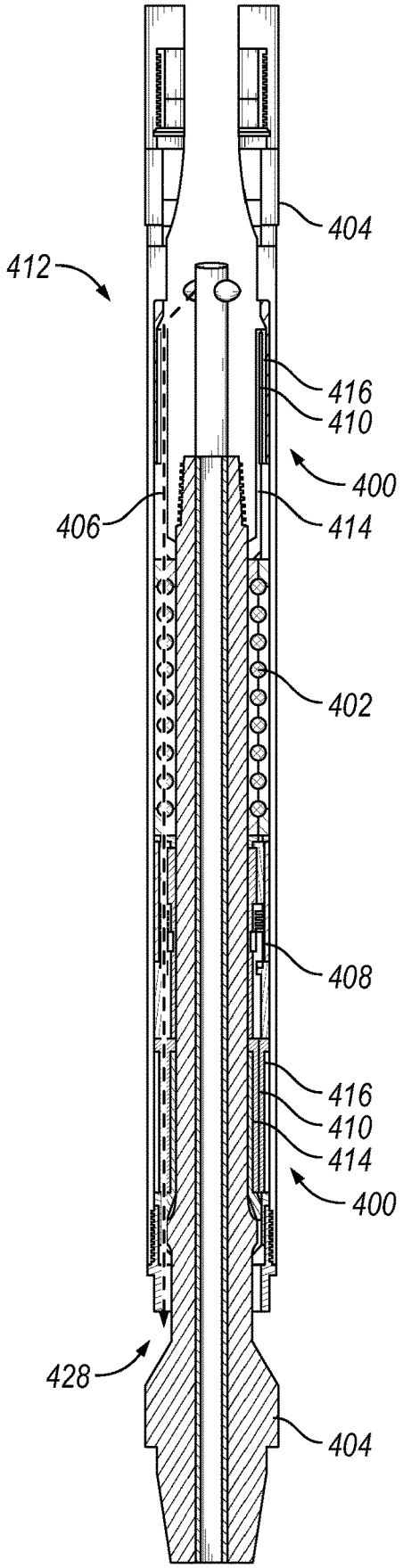
FIG. 4 is a bearing assembly, according to one or more embodiments.

Turning now to FIG. 4, FIG. 4 is a bearing assembly 412, according to one or more embodiments. The bearing assembly 412 includes radial bearing assemblies 400 and ball bearings 402 or roller bearings (not shown) that are positioned circumferentially around a driveshaft 404 that extends between a downhole motor (not shown) and a drill bit (not shown) to support the driveshaft 404. The bearing assembly 412 may also include thrust bearings (not shown).

A fluid flowpath 406 extends from the bore of the driveshaft 404, through the bearings 400, 402. As discussed above, a portion of drilling fluid passing through the driveshaft 404 is diverted through the fluid flowpath 406 to cool and lubricate the bearings 400, 402. A choke assembly 408, discussed in more detail below, is disposed within the fluid flowpath 406. The choke assembly 408 controls the amount of fluid that passes through the fluid flowpath 406 and into an annulus 428 surrounding the bearing assembly 412, for example, by restricting flow out of the flowpath 406 and into the annulus. By controlling the amount of drilling fluid passing into the annulus via the fluid flowpath 406, sufficient hydraulic pressure is maintained in the drilling fluid flowing through the driveshaft 404 to extend the pads of the RSS (not shown).

In at least one embodiment, one or both of the radial bearing assemblies 400 may also act to restrict the flow of fluid through the fluid flowpath 406. Specifically, a gap 410 formed between an inner cylinder 414 and an outer cylinder 416 may be sized to restrict the flow of fluid through the gap 410 and, thus, the fluid flowpath 406.

Figure 5:
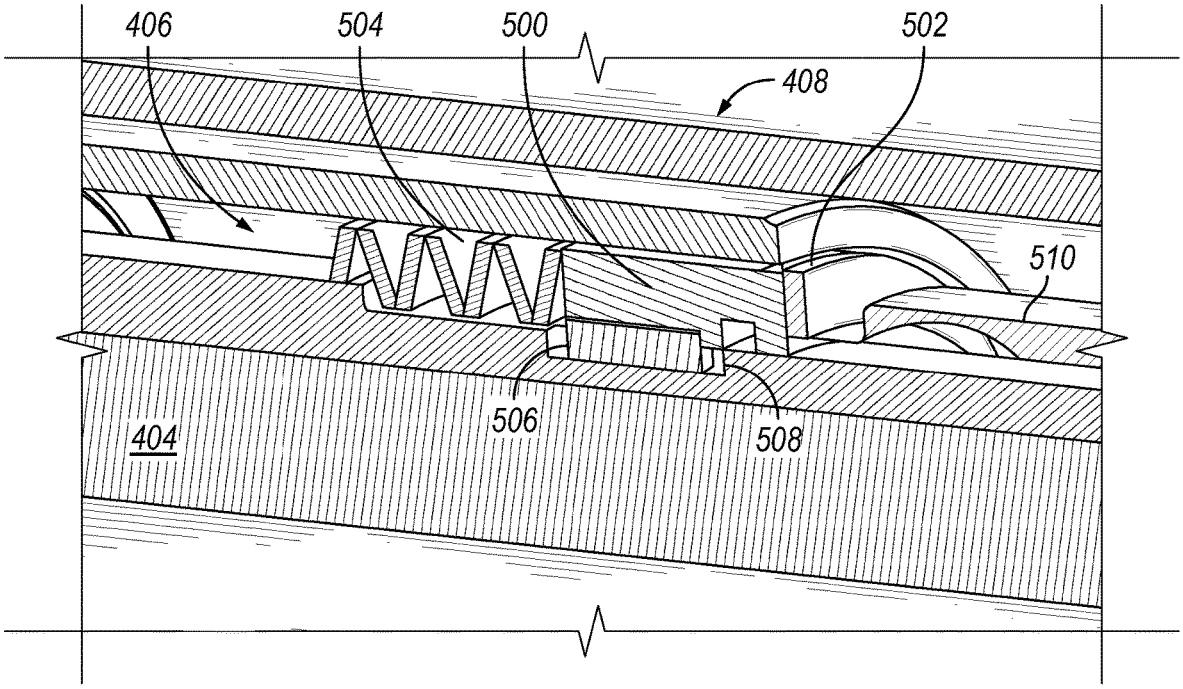
FIG. 5 is a choke assembly positioned within the bearing assembly of FIG. 4.

Turning now to FIG. 5, FIG. 5 is the choke assembly 408 positioned within the fluid flowpath 406 of the bearing assembly 412 of FIG. 4. The choke assembly 408 includes a choke 500 that contacts a seat 502 to restrict the amount of drilling fluid passing through the fluid flowpath 406. A biasing mechanism 504, such as a spring, exerts a biasing force on the choke 500 in a downhole direction based on the expected pressure of the drilling fluid and the pressure within the borehole annulus. In other embodiments, the seat 502 may be uphole of the choke 500 and the biasing mechanism 504 may exert a biasing force on the choke in an uphole direction based on the expected pressure of the drilling fluid and the pressure within the borehole annulus.

The choke 500 and the seat 502 control the amount of drilling fluid that is diverted from the driveshaft to cool and lubricate the bearings. The baising force shifts the choke 500 into contact with the seat such that the exemplary choke assembly 408 maintains hydraulic pressure available for pads. For example, the choke assembly may only allow a range between approximately 1% and approximately 7% of the drilling fluid passing through the driveshaft 404 to be diverted into the fluid flowpath 406. Additionally, the choke 500 and/or the seat may include channels (not shown) extending axially through the choke 500 and/or the seat 502 to ensure that between approximately 1% and approximately 7% of the drilling fluid can pass through the choke assembly 408 when the choke 500 contacts the seat. However, other choke assemblies 408 may allow less than 1% or more than 7% of the drilling fluid to pass through the fluid flowpath 406 as appropriate.

The choke assembly 408 also includes one or more keys 506 coupled to or integral with the choke 500 that engage with one or more respective slots 508 formed in an inner housing 510 surrounding the driveshaft 404 or the driveshaft 404 itself. Once the choke 500 is installed around the inner housing 510, the key 506 and slot 508 allow relative axial movement between the choke 500 and the inner housing 510 such that the choke 500 can contact the seat 502, but prevent relative rotational movement between the choke 500 and the inner housing 510, since relative rotation between the choke 500 and the seat 502 can cause increased wear on the choke 500 and/or seat 502.

Figure 6:
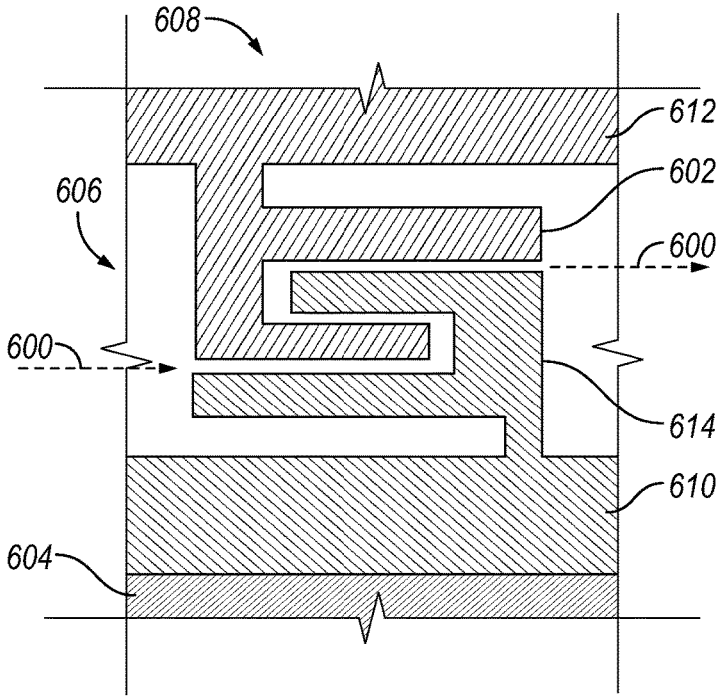
FIG. 6 is a choke assembly for use with a bearing assembly, according to one or more embodiments.

Turning now to FIG. 6, FIG. 6 is another embodiment of a choke assembly 608 for use with a bearing assembly, according to one or more embodiments. FIG. 6 includes features that are similar to the features described above with reference to FIG. 5. Accordingly, such features will not be described again in detail, except as necessary for the understanding of the choke assembly 608 shown in FIG. 6.

The choke assembly 608 includes a tortuous flowpath 600 created between an outer labyrinth choke portion 602 coupled to or integral with an outer housing 612 surrounding a driveshaft 604 and an inner labyrinth choke portion 614 coupled to or integral with an inner housing 610 surrounding the driveshaft 604. The tortuous flowpath 600 controls the amount of drilling fluid that is diverted from the driveshaft to cool and lubricate the bearings. As there is no key assembly within the choke assembly 608, the inner labyrinth choke may rotate relative to the outer labyrinth choke. Similar to the choke assembly 408 described above with reference to FIG. 5, the exemplary choke assembly 608 is shaped to only allow a range between approximately 1% and approximately 7% of the drilling fluid passing through the driveshaft 604 to be diverted into the fluid flowpath 606. However, other choke assemblies 608 may allow less than 1% or more than 7% of the drilling fluid to pass through the fluid flowpath 606.

Further examples include:

Example 1 is a drilling system for drilling a borehole. The drilling system includes a drill string, a drill bit coupled to the drill string, a mud motor coupled to the drill string uphole of the drill bit and operable to rotate the drill bit via a driveshaft, a bearing assembly coupled to a downhole end of the mud motor and operable to support the driveshaft, and a rotary steerable system ("RSS") operable to push the drill bit in a desired direction via pads extended using drilling fluid flowing through the driveshaft and to the RSS. The bearing assembly includes bearings positioned circumferentially around a bore of the bearing assembly, a fluid flowpath through the bearings to allow drilling fluid to pass through the bearings, and a choke assembly positioned in the fluid flowpath and operable to restrict a flow of the drilling fluid through the fluid flowpath.

In Example 2, the embodiments of any preceding paragraph or combination thereof further include wherein the choke assembly includes a choke axially movable within the fluid flowpath to contact a seat and restrict fluid flow through the fluid flowpath and a biasing mechanism positioned within the fluid flowpath to bias the choke into contact with the seat.

In Example 3, the embodiments of any preceding paragraph or combination thereof further include wherein the choke assembly further includes a key coupled to the choke and positioned in a slot formed in an inner housing surrounding the driveshaft to prevent relative rotational movement between the inner housing and the choke and allow relative axial movement between the inner housing and the choke.

In Example 4, the embodiments of any preceding paragraph or combination thereof further include wherein the bearings comprise a radial bearing assembly shaped to restrict the flow of the drilling fluid through the fluid flowpath.

In Example 5, the embodiments of any preceding paragraph or combination thereof further include wherein the choke assembly includes a tortuous flowpath to restrict the flow of drilling fluid through the fluid flowpath.

In Example 6, the embodiments of any preceding paragraph or combination thereof further include wherein an outer labyrinth choke portion and an inner labyrinth choke portion are positioned within the fluid flowpath to form the tortuous flowpath.

In Example 7, the embodiments of any preceding paragraph or combination thereof further include wherein the fluid flowpath exits the bearing assembly to an annulus surrounding the bearing assembly.

In Example 8, the embodiments of any preceding paragraph or combination thereof further include wherein the choke assembly allows a range between approximately 1% and approximately 7% of the drilling fluid flowing through the drill string to be diverted into the fluid flowpath.

In Example 9, the embodiments of any preceding paragraph or combination thereof further include wherein the choke assembly is operable to restrict the flow of drilling fluid such that a pressure of the drilling fluid flowing through the driveshaft is sufficient to extend the pads of the RSS.

Example 10 is a method of drilling a borehole. The method includes pumping drilling fluid down a drill string within the borehole to a mud motor, a bearing assembly, a RSS, and a drill bit. The method also includes rotating a drill bit with the mud motor via a driveshaft. The method further includes extending pads of the RSS via the drilling fluid passing through the driveshaft to push a drill bit in a desired direction using the drilling fluid. The method also includes diverting a portion of the drilling fluid through bearings of the bearing assembly. The method further includes restricting a flow of the drilling fluid through the bearings via a choke assembly.

In Example 11, the embodiments of any preceding paragraph or combination thereof further include wherein restricting the flow of the drilling fluid through the bearings via the choke assembly includes biasing a choke of the choke assembly positioned within a fluid flowpath through the bearings against a seat of the choke assembly positioned within the fluid flowpath.

In Example 12, the embodiments of any preceding paragraph or combination thereof further include preventing relative rotational movement between the choke and an inner housing of the choke assembly.

In Example 13, the embodiments of any preceding paragraph or combination thereof further include restricting the flow of the drilling fluid through the bearings via the choke assembly includes restricting the flow of the drilling fluid through the bearings via a tortuous flowpath formed by the choke assembly.

In example 14, the embodiments of any preceding paragraph or combination thereof further include flowing the portion of the fluid from the bearings to an annulus surrounding the bearing assembly.

In Example 15, the embodiments of any preceding paragraph or combination thereof further include wherein restricting the flow of the drilling fluid through the bearings via the choke assembly includes restricting the flow of the drilling fluid through the bearings via the choke assembly such that a pressure of the drilling fluid flowing through the driveshaft is sufficient to extend the pads of the RSS.

Example 16 is bearing assembly for use with a downhole motor rotated via drilling fluid. The bearing assembly includes bearings positioned circumferentially around a bore of the bearing assembly to support a driveshaft extending from the downhole motor, a fluid flowpath through the bearings to allow drilling fluid to pass through the bearings, and a choke assembly positioned in the fluid flowpath and operable to restrict a flow of the drilling fluid through the fluid flowpath.

In Example 17, the embodiments of any preceding paragraph or combination thereof further include wherein the choke assembly includes a choke axially movable within the fluid flowpath to contact a seat and restrict fluid flow through the fluid flowpath and biasing mechanism positioned within the fluid flowpath to bias the choke into contact with the seat.

In Example 18, the embodiments of any preceding paragraph or combination thereof further include wherein the choke assembly further includes a key coupled to the choke and positioned in a slot formed in an inner housing surrounding the driveshaft to prevent relative rotational movement between the inner housing and the choke and allow relative axial movement between the inner housing and the choke.

In Example 19, the embodiments of any preceding paragraph or combination thereof further include wherein the choke assembly includes a tortuous flowpath to restrict the flow of drilling fluid through the fluid flowpath.

In Example 20, the embodiments of any preceding paragraph or combination thereof further include wherein the fluid flowpath exits the bearing assembly to an annulus surrounding the bearing assembly.

Certain terms are used throughout the description and claims to refer to particular features or components. As one skilled in the art will appreciate, different persons may refer to the same feature or component by different names. This document does not intend to distinguish between components or features that differ in name but not function.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Reference throughout this specification to "one embodiment," "an embodiment," "embodiments," "some embodiments," "certain embodiments," or similar language means that a particular feature, structure, or characteristic described in connector with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A drilling system for drilling a borehole using a drilling fluid, the drilling system comprising:

a drill string;

a mud motor coupled to the drill string and comprising a driveshaft comprising a bore through which the drilling fluid is flowable;

a bearing assembly coupled to a downhole end of the mud motor and operable to support the driveshaft, the bearing assembly comprising:

bearings positioned circumferentially around a bore of the bearing assembly;

a fluid flowpath through the bearings and in fluid communication with the bore of the driveshaft to allow drilling fluid to divert from the bore and pass through the bearings; and a choke assembly positioned in the fluid flowpath and operable to restrict a flow of the drilling fluid out of the fluid flowpath;

a rotary steerable system ("RSS") operable to extend pads using drilling fluid not diverted through the fluid flowpath and flowing through the driveshaft and to the RSS; and a drill bit rotatable by the driveshaft and steerable in a desired direction by the RSS.

2. The drilling system of claim 1, wherein the choke assembly comprises:

a choke axially movable within the fluid flowpath to contact a seat and restrict fluid flow through the fluid flowpath; and a biasing mechanism positioned within the fluid flowpath to bias the choke into contact with the seat.

3. The drilling system of claim 2, wherein the choke assembly further comprises a key coupled to the choke and positioned in a slot formed in an inner housing surrounding the driveshaft to prevent relative rotational movement between the inner housing and the choke and allow relative axial movement between the inner housing and the choke.

4. The drilling system of claim 1, wherein the bearings comprise a radial bearing assembly shaped to restrict flow of the drilling fluid out the fluid flowpath.

5. The drilling system of claim 1, wherein the choke assembly comprises a tortuous flowpath to restrict flow of the drilling fluid out the fluid flowpath.

6. The drilling system of claim 5, wherein an outer labyrinth choke portion and an inner labyrinth choke portion are positioned within the fluid flowpath to form the tortuous flowpath.

7. The drilling system of claim 1, wherein the fluid flowpath exits the bearing assembly to an annulus surrounding the bearing assembly.

8. The drilling system of claim 1, wherein the choke assembly allows a range between approximately 1% and approximately 7% of the drilling fluid flowing through the drill string to be diverted into the fluid flowpath.

9. The drilling system of claim 1, wherein the choke assembly is operable to restrict flow of the drilling fluid such that a pressure of the drilling fluid flowing through the driveshaft is sufficient to extend the pads of the RSS.

10. A method of drilling a borehole, the method comprising:

pumping drilling fluid down a drill string within the borehole to a mud motor, a bearing assembly, a RSS, and a drill bit;

rotating the drill bit via a driveshaft driven by the mud motor powered by the drilling fluid;

diverting a portion of the drilling fluid from the driveshaft and through bearings of the bearing assembly;

restricting a flow of the drilling fluid out of the bearings via a choke assembly;

extending pads of the RSS using the drilling fluid passing through the driveshaft and not diverted through the bearings to push the drill bit in a desired direction.

11. The method of claim 10, wherein restricting the flow of the drilling fluid out of the bearings via the choke assembly comprises biasing a choke of the choke assembly positioned within a fluid flowpath through the bearings against a seat of the choke assembly positioned within the fluid flowpath.

12. The method of claim 11 further comprising preventing relative rotational movement between the choke and an inner housing of the choke assembly.

13. The method of claim 10, wherein restricting the flow of the drilling fluid out of the bearings via the choke assembly comprises restricting the flow of the drilling fluid via a tortuous flowpath formed by the choke assembly.

14. The method of claim 10, further comprising flowing the portion of the drilling fluid from the bearings to an annulus surrounding the bearing assembly.

15. The method of claim 10, wherein restricting the flow of the drilling fluid out the bearings via the choke assembly comprises restricting the flow of the drilling fluid via the choke assembly such that a pressure of the drilling fluid flowing through the driveshaft is sufficient to extend the pads of the RSS.

16. A bearing assembly for rotatably supporting a driveshaft rotated by a downhole motor rotated via drilling fluid, the bearing assembly comprising:

bearings positioned circumferentially around a bore of the bearing assembly to rotatably support the driveshaft extending from the downhole motor;

a fluid flowpath through the bearings and in fluid communication with a bore of the driveshaft to allow drilling fluid to divert from the bore and pass through the bearings; and a choke assembly positioned in the fluid flowpath and operable to restrict a flow of the drilling fluid out of the fluid flowpath and maintain a minimum pressure within the bore of the driveshaft.

17. The bearing assembly of claim 16, wherein the choke assembly comprises:

a choke axially movable within the fluid flowpath to contact a seat and restrict fluid flow through the fluid flowpath; and a biasing mechanism positioned within the fluid flowpath to bias the choke into contact with the seat.

18. The bearing assembly of claim 17, wherein the choke assembly further comprises a key coupled to the choke and positioned in a slot formed in an inner housing surrounding the driveshaft to prevent relative rotational movement between the inner housing and the choke and allow relative axial movement between the inner housing and the choke.

19. The bearing assembly of claim 16, wherein the choke assembly comprises a tortuous flowpath to restrict flow of the drilling fluid out of the fluid flowpath.

20. The bearing assembly of claim 16, wherein the fluid flowpath exits the bearing assembly to an annulus surrounding the bearing assembly.

* * * * *